United States Patent [19]

Yesbick

[11] Patent Number: 4,848,014

[45] Date of Patent: Jul. 18, 1989

[54] AIR CHAMBERED PICTURE FRAME

[76] Inventor: Jonathan Yesbick, 3708 Bridgewood Dr., Boca Raton, Fla. 33434

[21] Appl. No.: 150,087

[22] Filed: Jan. 29, 1988

[51] Int. Cl.[4] ..... G09F 19/00

[52] U.S. Cl. ..... 40/124.5; 40/152

[58] Field of Search ..... 40/124.5, 661, 154, 40/158.1, 594, 152

[56] References Cited

U.S. PATENT DOCUMENTS

| | | | |
|---|---|---|---|
| 953,053 | 3/1910 | McMullen | 40/124.5 |
| 2,137,156 | 11/1938 | Clark | 40/158.1 |
| 2,820,310 | 1/1958 | John | 40/152 |
| 3,694,947 | 10/1972 | Mukai et al. | 40/152 |

FOREIGN PATENT DOCUMENTS

| | | | |
|---|---|---|---|
| 2415988 | 10/1979 | France | 40/594 |

*Primary Examiner*—Gene Mancene
*Assistant Examiner*—Cary E. Stone
*Attorney, Agent, or Firm*—Malin, Haley & McHale

[57] ABSTRACT

The invention relates to a frame assembly wherein the frame and viewing area are integrally formed of clear plastic or plexiglass eliminating the need for a separate glass pane. The front frame area is provided with a roughened surface to reduce visibility therethrough while the inner margin is slightly bevelled to accentuate the center viewing area. The back of the frame assembly is provided with a recess for receiving a plastic backing plate having two-way tape on each side. The backing plate, with the picture or document attached to one side, is inserted into the recess on the back of the frame assembly. After the backing plate and picture are firmly inserted into the recess a seal is formed around the periphery of the backing plate to prevent moisture or foreign matter from entering. Subsequent removal of the second peel-off tape exposes a second adhesive coating on the outer surface of the backing plate to permit the frame assembly to be attached to any desired surface.

13 Claims, 1 Drawing Sheet

Fig.1.
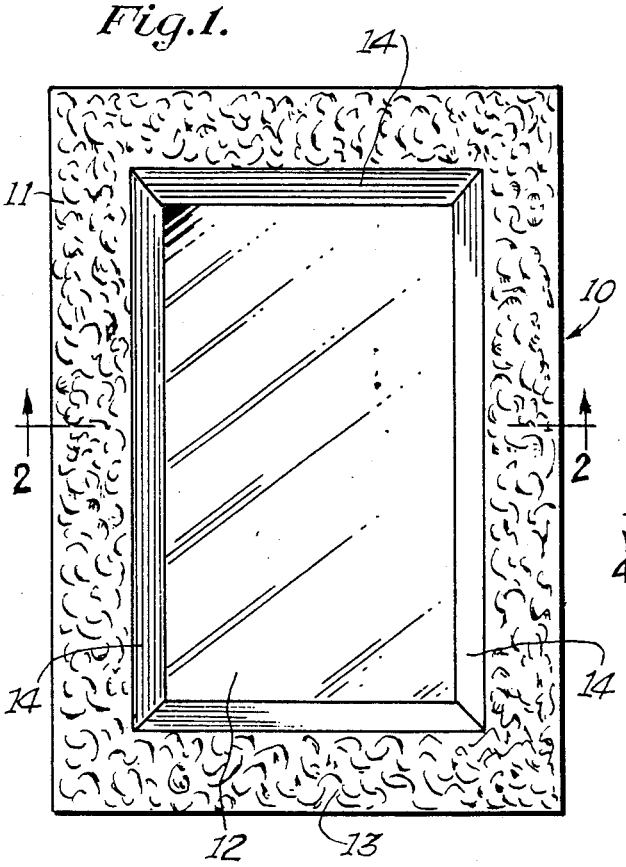
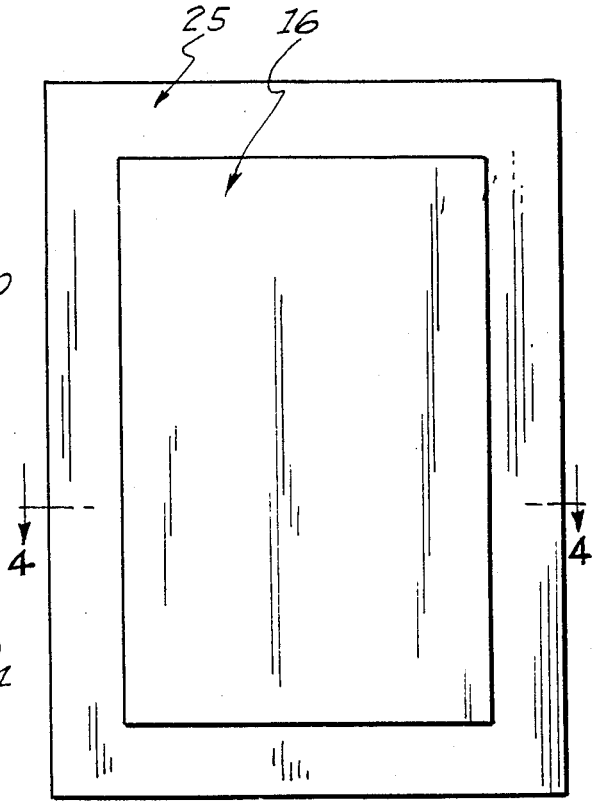
Fig.3.
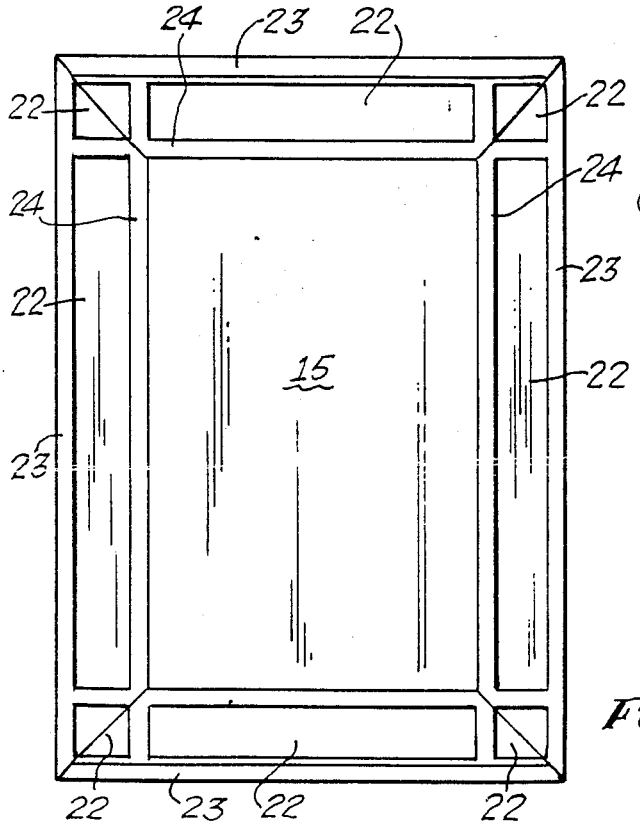
Fig.5.
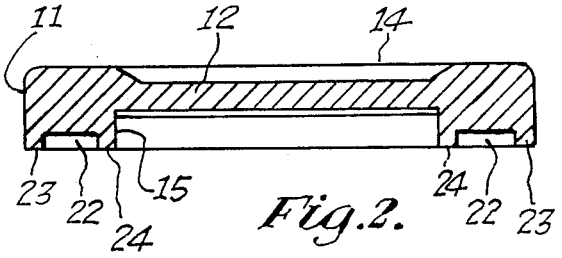
Fig.2.
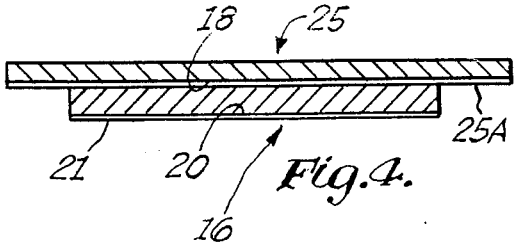
Fig.4.

AIR CHAMBERED PICTURE FRAME

BACKGROUND OF THE INVENTION

Picture frames and frames for diplomas, awayrds, licenses, and many other types of important documents have been known for a long time. Through the years many types of frames have appeared on the open market.

However, all of the known frames, whether they are used for pictures or any other type document considered worthy of a frame, are usually provided with a glass pane to protect the picture. The main disadvantage of the use of glass is the fact that it is easily broken. Another drawback of most known frames is the fact that some form of attachment is needed to hang them ona wall or other supporting surface. Usually, a pair of eye-screws are threaded into the frame and either strands of picture wire or strong twine are looped through the eye-screws and then hung on a nail or other type of picture hook.

The instant invention also finds use as a grave marker, for either humans or pets. As a result of this particular use it was designed with the knowledge that the frame would constantly be exposed to the elements. In northern climates, snow, ice, sleet and rain where the factors to be considered. While in the southern climates, rain, heat and moisture were the main considerations.

Another use for the subject invention is aboard boats and ships where certificates and licenses of various types are required to be displayed in a prominant location, thus again exposing the documents to the elements. As can be seen from the above discussion there are an almost unlimited number of needs which the subject invention may be used to satisfy.

SUMMARY OF THE INVENTION

In view of the many and varied needs for a durable frame assembly whether it be used for pictures, frames, documents, diplomas, licenses, etc. and the range of environments to which it would be exposed, applicant has undertaken to develop a frame assembly which will effectively fulfill these requirements.

Accordingly, applicant has developed a frame assembly that is capable of withstanding a wide range of temperatures, both hot and cold. Additionally, applicant has eliminated the need for a separate glass pane and thereby obviated the most frequent problem associated with conventional frames, i.e. breakage. Further, applicant has designed a novel frame which cooperates with a pair of novel backing plates which serve several very important functions. Firstly, the novel frame is provided with a central recess which receives a first backing plate with the attached photograph thus providing surface support to the attached picture or other document. Secondly, the rear face of the frame's border is provided with a plurality of shallow recesses which are overlaid by a second backing plate of lesser thickness than said first back plate. The shallow recesses in the rear face of the frame present a pair of sealing ribs on each of the four sides of the frame. Each pair of sealing ribs cooperates with the second backing plate to form a first and second sealing surface to prevent the entry of rain, moisture, dirt, etc. which would have a deleterious effect on the picture or document within the frame. The second backing plate also eliminates the need for eye-screws, nails, picture-hooks and the like, which are normally required in the hanging or mounting process. It accomplishes this through the use of an appropriate adhesive which is exposed by merely peeling off the covering tape in the same manner as the first backing plate. Since the frame assembly is made of lightweight plastic and the backing plate presents a smooth surface it is readily attached by applying pressure across the front of the frame with one's hand.

OBJECTS OF THE INVENTION

An object of the invention is to provide an economical frame assembly that can readily withstand exposure to the elements.

A further object of the invention is the provision of a multi-use frame assembly.

Yet another object of the invention is to provide a frame assembly equipped with a backing plate which seals the enclosed picture, license, or document.

A still further object of the invention is the provision of a frame assembly useable as a grave marker whether it be human or animal.

Another object of the invention is to provide an integral frame assembly eliminating the need for a separate breakable glass pane.

Yet another object of the invention is the provision of a frame assembly with an adhesive coated backing plate for mounting.

These and other objects of the instant invention will become more apparent hereinafter, the instant invention will now be described with particular reference to the accompanying drawings which form a part of this specification wherein like reference characters designate the corresponding parts in the several views.

BRIEF DESCRIPTION OF THE DRAWINGS

FIG. 1 is a plan view of the novel frame assembly with an integral viewing area.

FIG. 2 is a sectional view taken along the line 2—2 of FIG. 1.

FIG. 3 is a plan view of the backing plate.

FIG. 4 is a sectional view taken along the line 4—4 of FIG. 3.

FIG. 5 is a rear elevational view of the frame shown in FIG. 1.

DETAILED DESCRIPTION OF THE DRAWINGS

Referring now to FIG. 1, there is shown a front plan view of the frame assembly generally indicated by reference numeral 10. Frame assembly 10 comprises an integrally molded frame 11 and a viewing area 12. As indicated in FIG. 1, frame 11 is provided with a roughened surface 13 which serves to make the frame 11 opaque and also places emphasis on the viewing area 12 which is clear and translucent. The entire frame assembly is molded of polyethylene which is transparent. However, as pointed out above, frames area 11 has a roughened surface 13 which provides contrast with the viewing area 12 and thus highlights or directs attention thereto. Inward of frame 11 and its roughened surface 13 is an inwardly directed bevelled surface 14 which meets the flat viewing area 12. This bevelled surface 14 also serves to direct further attention to viewing area 12.

Although it was previously indicated that the frame assembly 10 was molded, there are a number of different types of fabrication and forming processes which could be utilized. For example, injection molding, hot stamping or vacuum forming could be utilized. However, the manner of forming frame assembly 10 is not considered to be part of the instant invention. Additionally, the use of polyethylene as the material from which the frame assembly 10 is made assures that there will be no cracking, discoloring, joint separation due to warping, or blistering due to exposure to the elements whether it is hot or cold exposure.

Referring now to FIG. 2 there is shown a sectional view taken along the line 2—2 of FIG. 1 with reference numeral 12 indicating the viewing area as being of substantial thickness to resist breakage. As further shown in FIG. 2, the back or rear side of frame assembly 10 is provided with a recess 15 which is adapted to receive first backing plate 16. The dimensions of recess 15 are such that there is an interference fit between recess 15 and the outside dimensions of first backing plate 16, i.e. once first backing plate 16 has been inserted into recess 15 a seal is formed around the peripheral edges thereof and moisture, water, or the like are prevented from entering.

Referring now to FIG. 3, there is shown, in plan view, first backing plate 16. As illustrated, the upper layer of peel-off tape is not shown. Overlaying first backing plate 16 is second backing plate 25, the outside dimensions of which conform to the outside dimensions of frame assembly 10. As illustrated, upper peel off tape has been removed to expose the adhesive side which mates with adhesive layer 25A on second backing plate 25, see FIG. 4.

Referring now to FIG. 4, there is shown a sectional view taken along the line 4—4 of FIG. 3. Backing plate, generally indicated by reference numeral 16, is formed of a core member 19 which is made of polyvinylchloride or other suitable plastic. As shown in FIG. 4, core member 19 is provided with an upper and lower double adhesive strip, 18 and 20, respectively. The term 'double adhesive' means that strips 18 and 20 have adhesive on both sides. Upper double adhesive strip 18 is provided with an upper peel-off tape 17 and lower double adhesive strip 20 is provided with a lower peel-off tape 21. One adhesive side of each strip is used to attach the strip to core 19.

Referring now to FIG. 5, there is shown a rear view of frame assembly 10 as found in FIG. 1. Frame 11 is provided with a plurality of recesses 22 which are provided in the rear surface of frame 11. On each side of recesses 22 are a pair of sealing ribs 23 and 24 which cooperate with second backing plate 25 denoted by broken lines in FIG. 3. Second backing plate 25 conforms to the outer dimensions of frame 11 and is provided with adhesive tape on each side covered with peel-off tape in the same manner as first backing plate 16.

The manner of mounting a picture, diploma or document in the novel frame assembly will now be described. First, the picture or document is measured and cut to conform to the dimensions of first backing plate 16. After this has been done, upper peel-off tape is removed from the backing plate thus exposing the upper surface of upper double adhesive strip 18. The picture is placed on top of adhesive strip 18 and pressed firmly thereon to ensure a good bond between the picture and adhesive strip 18. The first backing plate 16 with the picture attached thereto is now inserted into recess 15 in the rear of frame assembly 10. Care must be taken that the correct side is facing the viewing area. Once first backing plate 16 is fitted into the recess, with the frame assembly 10 on a sturdy surface, uniform pressure on first backing plate 16 will force it to completely enter recess 15 and simultaneously provide a secondary seal to keep out dirt, moisture, etc. Having inserted first backing plate 16 into recess 15, the peel-off tape 21 is removed from first backing plate 16 and the peel-off tape from a first side of second backing plate 25 is removed and pressed over the rear of frame assembly 10 with the adhesive layer on each backing plate coming into contact with each other. In applying second backing plate 25 the exposed adhesive layer comes into contact with sealing ribs 23 and 24 on each side of frame assembly 10. Thus, the primary seal is provided by sealing ribs 23 and 24 with a recess 22 therebetween to trap any moisture, dirt or rain should it get by outer sealing rib 23. When it is desired to attach the frame assembly 10 to another surface, regardless of the type of surface, one merely has to peel off lower peel-off tape 21, and press it firmly against the object surface desired. A variety of adhesives are available which can be utilized depending upon the supporting surface such as wood, plastic, granite, cement, wall board or metal.

Use of the novel frame assembly 10 indoors eliminates the need for eye-screws, picture wire and end nail holders as normally required with prior art units. Applicant has provided a simple, inexpensive and convenient way of overcoming problems associated with conventional frame assemblies.

As pointed out earlier, the instant invention has many and varied uses. Although frame assembly 10 is shown as rectangular in form it is not to be limited to such a configuration. Other shapes such as oval, circular, triangular, etc., may be utilized applying the same principles to these other forms. Further, the dimensions of frame assembly 10 may be varied according to the purpose for which the frame assembly 10 is being used.

While the invention has been described in its preferred embodiment, it is to be understood that words which have been used are words of description rather than limitation and that changes may be made within the purview of the appended claims without departing from the full scope or spirit of the invention.

Having thus described my invention, I claim:

1. In combination a frame means and backing plate means wherein said frame means comprises a unitary frontal frame and viewing portion, first recess means centrally located in the rear of said frame means, additional recess means formed in the rear of said frame means with a sealing rib on each side of said additional recess means, said backing plate means comprising a first and second backing plate, each of said backing plates having a first and second surface and including adhesive means attached to each of said first and second surfaces with protective peel-off tape covering said adhesive covered surfaces, indicia means attached to a first surface of said first backing plate after said peel-off tape has been removed and prior to the insertion of said first backing plate means into said first recess means in sealing relation thereto; said additional recess means and sealing ribs cooperating with said second backing plate to form a surface seal on each side of said additional recess means when said peel-off tapes have been removed from said second surface of said first backing plate and said first surface of said second backing plate, subsequent application of pressure bringing said second backing plate into close contact with said sealing ribs and said first backing plate thus permitting said peel-off tape to be removed from said second surface of said second backing plate whereby said entire unit may be affixed to a desired surface means.

2. The combination as set forth in claim 1 wherein said unitary frontal frame and viewing portion are formed of clear plastic; said unitary frontal frame having a roughened outer surface thus rendering it opaque; said unitary frontal frame also having an inwardly bevelled surface of clear plastic; said roughened surface on said frontal frame and said inwardly bevelled surface serving to direct attention to said viewing portion.

3. The combination as set forth in claim 1 wherein said unitary frontal frame and viewing portion are formed of a plastic material which is highly resistant to cracking, blistering and discoloring.

4. The combination as set forth in claim 3 wherein said plastic material is polethylene.

5. The combination as set forth in claim 1 wherein said first recess means conforms in size and shape with said viewing portion.

6. The combination as set forth in claim 1 wherein said first recess means conforms in size and shape with said first backing plate and the depth of said first recess means is substantially equal to the thickness of said first backing plate.

7. The combination as set forth in claim 1 wherein said second backing plate has outer dimensions conforming to the outer dimensions of said frontal frame.

8. The combination as set forth in claim 1 wherein said backing plates are made from a weather resistant material such as polyvinylchloride.

9. The combination as set forth in claim 1 wherein said frame means is provided with an outer peripheral bevelled edge.

10. The combination as set forth in claim 1 wherein said desired surface means is a tombstone made of granite.

11. The combination as set forth in claim 1 wherein said desired surface means is an interior wall of a home.

12. The combination as set forth in claim 1 wherein said desired surface means is an exposed surface of a boat.

13. In combination, frame means and backing plate means wherein said frame means comprises a unitary frontal frame and viewing portion, first recess means formed in the rear of said unitary frontal frame and viewing portion opposite said viewing portion, a rear border portion extending in all directions outwardly from said first recess means, additional recess means formed in said rear border portion resulting in a sealing rib on the inner and outer sides of said additional recess means, backing plate means comprising a first and second backing plate, each of said first and second backing plates having adhesive means on both surfaces thereof whereby indicia means are attached to one surface of said first backing plate prior to insertion into said first recess means and subsequent attachment of said second backing plate to said first backing plate and said rear border portion forms a plurality of peripheral seals due to contact with said sealing ribs.

* * * * *